US006413177B1

(12) United States Patent
Guenther et al.

(10) Patent No.: US 6,413,177 B1
(45) Date of Patent: Jul. 2, 2002

(54) SPORTS BALL WITH FLOATING COVER

(75) Inventors: Douglas G. Guenther, Wheaton; Bradley L. Gaff, Naperville, both of IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 09/738,741

(22) Filed: Dec. 16, 2000

(51) Int. Cl.[7] ..... A63B 41/00
(52) U.S. Cl. ..... 473/605; 473/594
(58) Field of Search ..... 473/594–597, 473/599, 603, 604, 605

(56) References Cited

U.S. PATENT DOCUMENTS

| | | | | |
|---|---|---|---|---|
| 3,119,618 A | | 1/1964 | Molitor et al. | |
| 4,239,568 A | | 12/1980 | Takazawa | |
| 4,333,648 A | | 6/1982 | Aoyama | |
| 4,462,590 A | | 7/1984 | Mitchell | |
| 4,660,831 A | | 4/1987 | Kralik | |
| 5,310,178 A | | 5/1994 | Walker et al. | |
| 5,542,662 A | | 8/1996 | Kouzai et al. | |
| 5,556,358 A | * | 9/1996 | Scatterday | 473/594 |
| 5,681,233 A | | 10/1997 | Guenther et al. | |
| 5,772,545 A | | 6/1998 | Ou | |
| 5,865,697 A | | 2/1999 | Molitor et al. | |
| 5,931,752 A | | 8/1999 | Guenther et al. | |
| 6,024,661 A | | 2/2000 | Guenther et al. | |
| 6,039,662 A | * | 3/2000 | Chan | 473/604 |
| 6,206,795 B1 | * | 3/2001 | Ou | 773/599 |

* cited by examiner

*Primary Examiner*—Steven Wong

(57) ABSTRACT

A game ball includes an inflatable bladder and a floating cover which can move relative to the bladder. The bladder is surrounded by a cloth liner which serves to retain the shape of the bladder. A second bladder or layer of elastomeric material surrounds the cloth liner and is movable relative to the cloth liner. A second cloth liner surrounds the second bladder, and the cover is adhesively attached to the second cloth liner.

11 Claims, 2 Drawing Sheets

SPORTS BALL WITH FLOATING COVER

BACKGROUND

This invention relates to sports balls or game balls, and, more particularly, to a sports ball having a cover which is movable with respect to an interior bladder.

Many sports balls and game balls include an inflatable bladder and a cover which surrounds the bladder. Such sports balls include, for example, volleyballs, basketballs, footballs, and soccer balls. Sports balls with inflatable bladders conventionally include a liner layer over the bladder for reinforcing the bladder and for maintaining the shape of the bladder. For example, volleyballs have included a cloth liner which surrounds the bladder. The cloth liner may be formed from a plurality of cloth sheets or panels which are dipped in latex adhesive or other adhesive and then applied to the outer surface of the inflated bladder. When the adhesive dries, the cloth panels are adhesively secured together and perhaps also adhesively secured to the bladder. The bladder and the liner layer form the carcass of the volleyball. The cover of the ball is formed from a plurality of panels of leather, synthetic leather, or other cover material which are adhesively secured to the liner layer. Volleyballs are described, for example, in U.S. Pat. Nos. 4,239,568 and 5,542,662.

Basketballs have included a wound liner layer which is formed by winding thread or filament around the inflated bladder. The thread is conventionally nylon or similar material and may be dipped in latex glue or polyurethane adhesive before being wound over the bladder. The carcass of a basketball is conventionally formed by applying a layer of rubber over the wound bladder and molding the resulting structure under heat and pressure. The cover is thereafter applied to the carcass. Basketballs are described, for example, in U.S. Pat. Nos. 5,310,178, 5,681,233, 5,931,752 and 6,024,661.

U.S. Pat. No. 4,239,568 describes a volleyball in which a layer 2 of lubricant such as talc is interposed between the bladder and a first cloth layer 3. The lubricant prevents the cloth layer from sticking to the bladder. However, the manufacturing process requires applying the cloth layer to a hollow sphere which is made from brittle material such as paraffin. The sphere is broken into pieces after the cloth layer is applied. The pieces of paraffin are removed through a slit in the cloth layer, and the bladder is inserted through the slit.

U.S. Pat. No. 5,542,662 describes a modified volleyball which includes a bladder 1 and a thin rubber pouch 2 which forms a covering layer over the bladder. The bladder is coated with an inorganic lubricant 3. The pouch is covered with latex-impregnated cloth 4 and a cover layer 6.

The prior art volleyballs in which a layer of lubricant covers the bladder can be referred to as floating bladder volleyballs. The floating bladder is not adhered to the cloth layer, and the volleyball has a softer feel than other prior art balls in which both the bladder and the cover were adhesively secured to the cloth layer.

SUMMARY OF THE INVENTION

The invention provides a volleyball or other sports ball with a floating cover rather than a floating bladder. Since the player feels the cover and not the bladder, better feel and performance is obtained if the cover can float relative to the carcass of the ball. The floating cover improves the dynamics of the ball and produces an even softer feel than a floating bladder.

The bladder is covered with an adhesive-impregnated layer of cloth which provides a load-carrying layer for retaining the shape of the bladder. The bladder and the attached cloth layer-form the carcass of the ball.

The carcass is separated from the cover by a layer of rubber or elastomeric material which is not attached to the carcass. The cover is applied over the elastomeric layer and is movable relative to the carcass. In the preferred embodiment, the elastomeric layer is covered with a layer of adhesive-impregnated cloth in order to facilitate adhesion of the cover to the elastomeric layer.

DESCRIPTION OF THE DRAWING

The invention will be explained in conjunction with the attached drawing, in which.

DESCRIPTION OF SPECIFIC EMBODIMENTS

Figure 1:
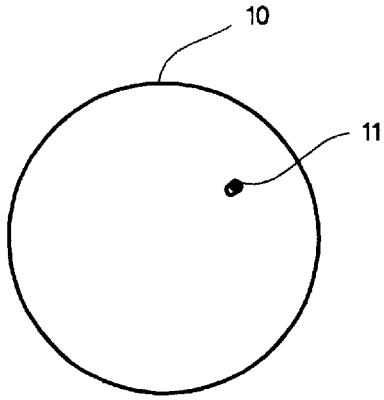
FIG. 1 illustrates a bladder, which is the first component of a sports ball which is formed in accordance with the invention.

FIG. 1 illustrates an inflatable bladder 10. The bladder can be formed from butyl rubber, natural rubber, or any other conventional bladder material. The preferred embodiment used 100% butyl. The bladder is inflated by a valve 11.

Figure 2:
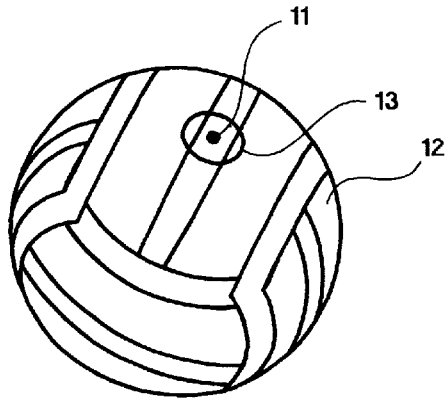
FIG. 2 illustrates the bladder of FIG. 1 covered with a layer or liner of adhesive-impregnated cloth.

FIG. 2 illustrates the bladder covered with a layer or liner 12 of adhesive-impregnated cloth. The liner is applied to the bladder 10 while the bladder is inflated so that the liner assumes the spherical shape which is desired for the completed ball. The liner is comprised of a plurality of separate cloth pieces 12*a* which are soaked with adhesive.

The preferred embodiment used a 60% polyester and 40% cotton cloth which was immersed in latex adhesive. About twelve pieces of cloth were applied to the bladder, and the cloth pieces overlapped by about 20 mm. A cloth patch 13 surrounds the valve 11.

The cloth-covered bladder is then placed in a mold and molded under heat while the bladder is pressurized. The cloth-covered bladder is thereafter molded in a cooled mold.

The bladder and cloth liner is adhered to the bladder by the latex adhesive. The combination of the bladder and the liner form the carcass of the ball.

The bladder pressure is reduced to 1 psi to hold the shape of the carcass while awaiting the next step in the manufacturing process.

Figure 3:
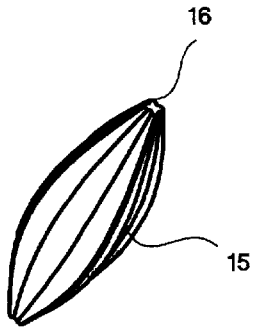
FIG. 3 illustrates a rubber or plastic bladder or liner which is used to cover the cloth-covered bladder of FIG. 2.
Figure 4:
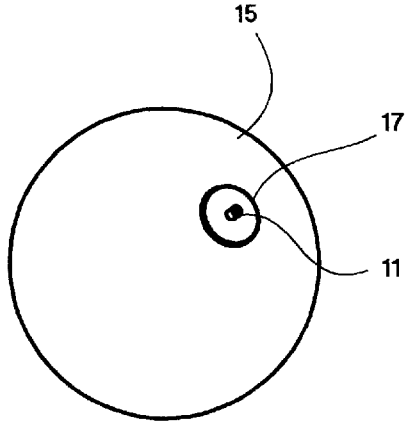
FIG. 4 illustrates the bladder of FIG. 3 covering the cloth-covered bladder of FIG. 2.
Figure 5:
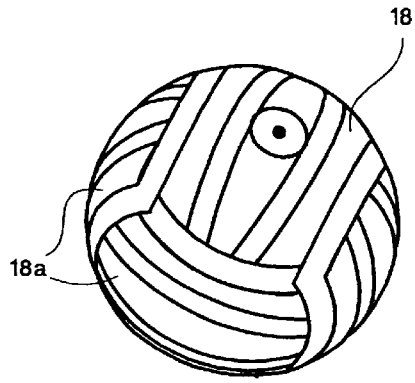
FIG. 5 illustrates a second layer or liner over the structure of FIG. 4.
Figure 6:
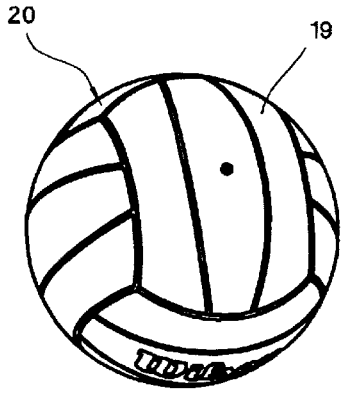
FIG. 6 illustrates a completed volleyball or sports ball.

The carcass is then deflated and inserted into a bladder or liner 15 (FIG. 3) having an opening 16. The bladder is preferably formed from latex rubber but can be formed from any suitable elastomeric material. The carcass and the outer bladder 16 are inflated through the valve 11, and a cloth patch 17 is adhesively applied to the bladder around the valve to cover the opening 16.

A second liner or layer 18 of adhesive-impregnated cloth is applied to the surface of the outer bladder 16. Eighteen pieces 18*a* of the same type of cloth which was used for the inner liner 12 are used, and the pieces overlap by about 20 mm. The cloth pieces 18*a* are oriented at 90° relative to the cloth pieces 12*a*.

The latex adhesive of the outer liner is allowed to dry for about two hours, and the product is then hot molded and cold molded as previously described for the carcass. The pressure is then reduced to 2 psi, and the weight, balance, size, and air leakage is tested.

Two coats of latex glue are then brushed onto the outer liner, allowing 20–30 minutes between coats. The latex glue is different than the latex adhesive which was used to impregnate the inner and outer cloth liners 12 and 18.

The product is then molded for 30–40 second under room temperature to mold lamination lines on the outer line for positioning the panels which form the cover. The bladder is pressurized at 3 kg/cm$^2$ during this molding step.

Two coats of latex glue are then applied to the inside surfaces of cover panels 19, and the cover panels are applied to the outer liner 18 to form a cover 20. The cover panels may be formed from leather, synthetic leather, rubber, or any other conventional cover material. A volleyball conventionally includes eighteen cover panels.

The ball then undergoes a final shaping/molding step at 40–45° C. and a pressure of 2–4 kg/cm$^2$. The molding time is 3 minutes for leather-covered balls and 5 minutes for synthetic leather-covered balls.

Figure 7:
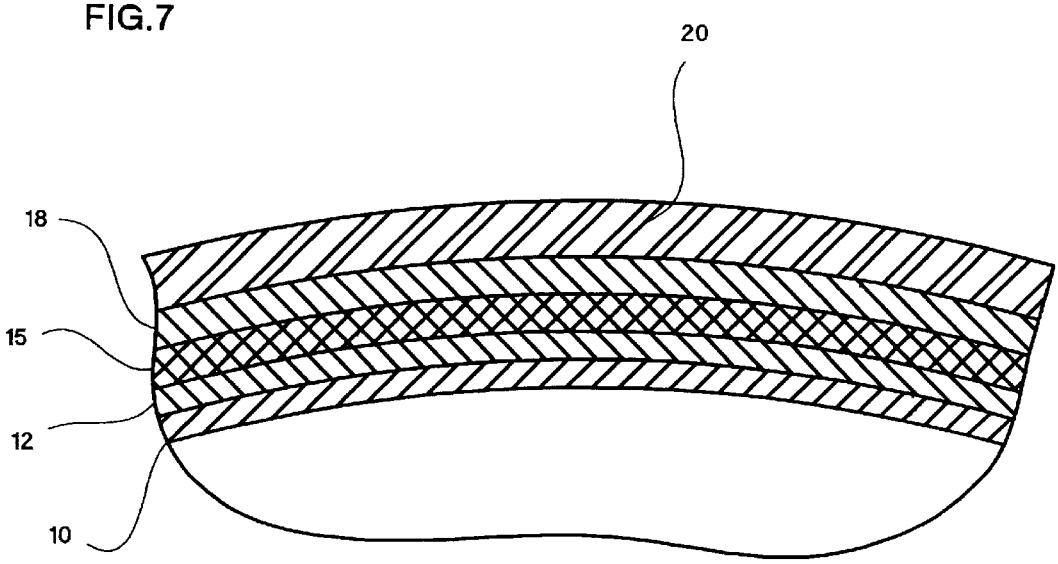
FIG. 7 is a fragmentary sectional view of the ball of FIG. 6.

Referring to FIG. 7, the latex layer 15 separates the cover from the carcass which is formed by the bladder 10 and the inner cloth layer 12. The latex layer is not attached to the carcass, and the latex layer and the cover are free to move relative to the carcass.

If desired, powder or release agent can be applied between the carcass and the latex layer 15. However, the latex can move relative to the carcass without the powder.

Volleyballs which are formed in accordance with the invention are faster and bounce higher than competitive volleyballs. When the ball impacts a player's hands, the cover moves relative to the carcass and the ball stays on the hands longer.

While in the foregoing specification a detailed description of specific embodiments of the invention has been set forth for the purpose of illustration, it will be understood that many of the details hereingiven can be varied considerably by those skilled in the art without departing from the spirit and scope of the invention.

We claim:

1. A game ball comprising:

an inflatable bladder, a liner layer surrounding the bladder, a one-piece layer of elastomeric material surrounding the liner layer, the layer of elastomeric material being movable relative to the first liner layer, and a cover surrounding the layer of elastomeric material and providing an outer surface for the game ball.

2. The game ball of claim 1 including a second liner layer between the layer of elastomeric material and the cover.

3. The game ball of claim 2 in which the first and second liner layers comprise cloth.

4. The game ball of claim 2 in which the first liner layer is adhesively secured to the bladder.

5. The game ball of claim 4 in which the second liner layer is adhesively secured to the layer of elastomeric material.

6. The game ball of claim 5 in which the cover is adhesively secured to the second liner layer.

7. The game ball of claim 2 in which the cover is adhesively secured to the second liner layer.

8. The game ball of claim 7 in which the second liner layer is adhesively secured to the layer of elastomeric material.

9. A new game ball comprising:

a carcass including an inflatable bladder having an outer surface, and a first liner coupled to, and substantially covering, the outer surface of the bladder; and a cover including an integral, generally spherical elastomeric layer and a plurality of cover panels, the elastomeric layer substantially covering the first liner, the elastomeric layer having and outer surface, the cover panels coupled to the outer surface of the elastomeric layer, the cover configured to move independently of the carcass during use.

10. The game ball of claim 9 further comprising a second liner disposed between the elastomeric layer and the cover panels.

11. The game ball of claim 9 further comprising one of a powder and a release agent between the first liner of the carcass and the elastomeric layer of the cover.

* * * * *